United States Patent [19]

Taylor et al.

[11] 4,440,221

[45] Apr. 3, 1984

[54] SUBMERGIBLE PUMP INSTALLATION

[75] Inventors: Donald F. Taylor; William G. Boyle, both of Dallas, Tex.

[73] Assignee: Otis Engineering Corporation, Dallas, Tex.

[21] Appl. No.: 186,980

[22] Filed: Sep. 15, 1980

[51] Int. Cl.[3] ..... E21B 43/00

[52] U.S. Cl. ..... 166/106; 166/321

[58] Field of Search ..... 166/321, 322, 323, 324, 166/105, 106, 53, 68, 72

[56] References Cited

U.S. PATENT DOCUMENTS

| | | | |
|---|---|---|---|
| 3,990,511 | 11/1976 | Gazda | 166/322 |
| 4,009,756 | 3/1977 | Zehren | 166/68 |
| 4,049,052 | 9/1977 | Arendt | 166/183 |
| 4,121,659 | 10/1978 | Taylor | 166/183 |
| 4,134,454 | 1/1979 | Taylor | 166/324 |
| 4,140,153 | 2/1979 | Deaton | 166/324 |
| 4,173,256 | 11/1979 | Kilgore | 166/324 |
| 4,273,186 | 6/1981 | Pearce et al. | 166/324 |

*Primary Examiner*—Ernest R. Purser
*Assistant Examiner*—William P. Neuder
*Attorney, Agent, or Firm*—Vinson & Elkins

[57] ABSTRACT

A submergible pump installation for wells comprising a submergible pump assembly adapted to be landed in position within the well bore for pumping well fluids to the surface, together with a safety system for the well including a subsurface valve or valves for maintaining the well under control as the pump is run into and removed from the well. At least one subsurface valve of the system is hydraulically actuated by the discharge pressure of the pump with the pressure fluid being conducted to the valve by a conducting means located exteriorly of the pump housing. The invention also contemplates the use of a novel poppet-type subsurface valve which may be suitably pressure balanced so that it is capable of being actuated by relatively low hydraulic control pressure supplied by the pump.

15 Claims, 14 Drawing Figures

Fig. 8
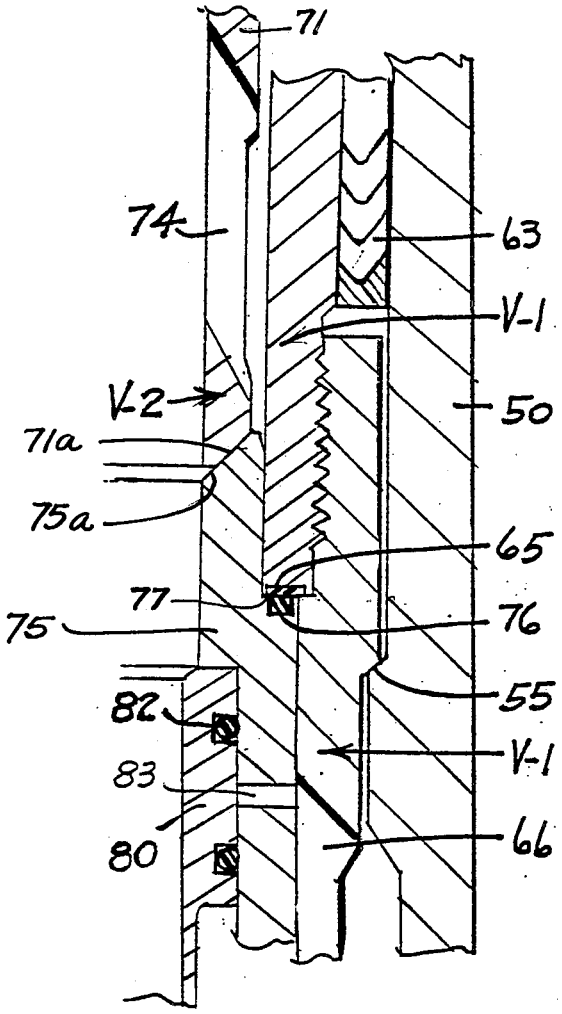
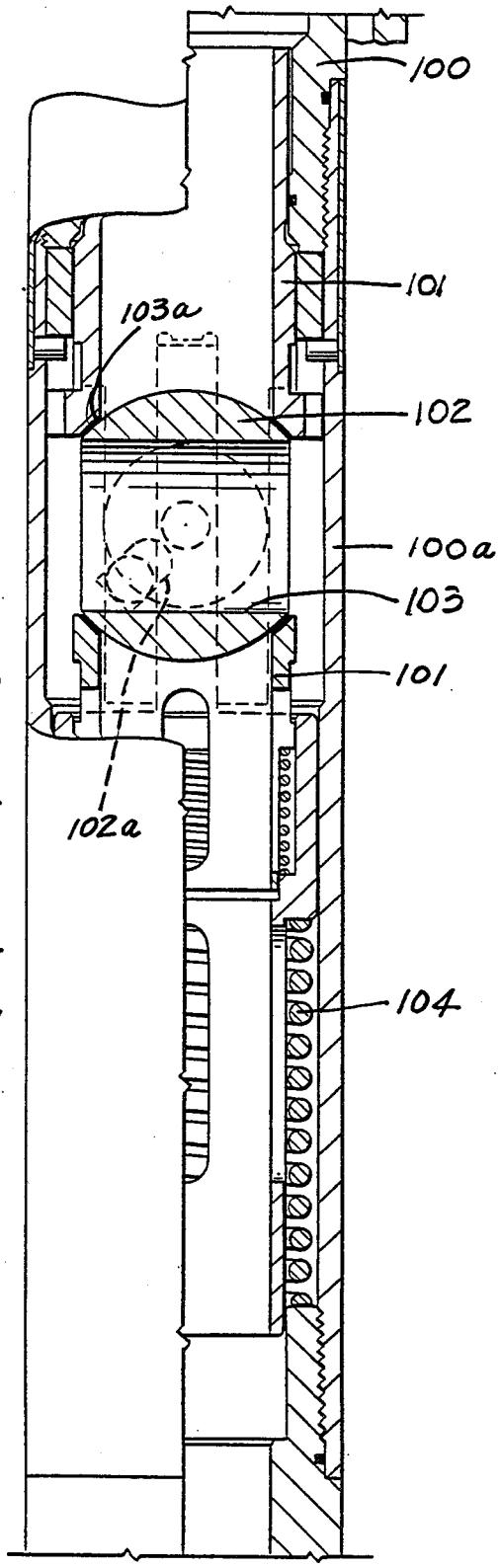
Fig. 10

SUBMERGIBLE PUMP INSTALLATION

This invention relates to new and useful improvements in submergible pump installations for wells and more particularly, to a safety system which maintains the well under control as such installations are run into or removed from the well. The invention also relates to a novel poppet-type safety valve used in said safety system.

BACKGROUND OF THE INVENTION

In the production of fluids from oil wells, it is general practice to utilize submergible pumping equipment when the subsurface formation pressure has fallen to a level at which some flow of well liquids to the surface occurs but said pressure is insufficient to bring the well liquids to the surface at the desired product rate. One type of pumping unit now in use is the submergible pump which is lowered into the well and which operates beneath the surface of the liquid, being powered by an electric motor.

Since formation pressure is adequate to produce some flow to the surface without the pumping unit, it is necessary to control the well and protect against blowout during the running in and removal of the pumping unit from the well. Such control and protection of the well is accomplished with safety systems which include various types of subsurface safety valves. Most subsurface safety valves are designed to control the fluid flow through a tubing string but in some instances the safety valve controls fluid flow in the annulus formed between the usual well casing and well tubing. This latter type is frequently referred to as an "annular" or poppet-type safety valve and one example of such valve is shown in U.S. Pat. No. 4,049,052.

Examples of prior art submergible pump installations including safety systems which utilize subsurface safety valves are disclosed in many prior patents and of particular interest are the installations and safety systems shown in prior U.S. Pat. Nos. 3,853,430, 4,121,659, 4,128,127 and 4,134,453.

In certain of such prior systems, the main subsurface safety valve is hydraulically controlled by the pump discharge pressure so that when the pump is operating, the valve is open; when pump operation ceases, the safety valve automatically closes. Pressure communication between the pump and the safety valve has heretofore been accomplished through the housing or jacket of the pump and this has made it necessary to physically connect the safety valve directly with the pump. As a result, removal of the pump from the well also removes the valve with the result that the well is left unprotected with no safety valve. U.S. Pat. Nos. 4,134,454 and 4,128,127 illustrate this type of arrangement.

In order to provide some means of shutting the well in so that the pumping equipment and safety valve may be removed, the prior U.S. Pat. No. 4,121,659 adds a second valve which is independently mounted in the well tubing below the pump and the hydraulically controlled safety valve. Although not physically connected to the pump, this second or foot valve must be opened during the pumping operation and opening is accomplished mechanically by means of a prong which extends downwardly from the pump-safety valve assembly. When such pump-safety valve assembly is removed from the well, the prong disengages the foot valve to permit its closure by spring force. In this type of installation, the second or foot valve is essential and since it is mechanically controlled, it must be located relatively close to the pump unit.

Also in those prior systems which utilize the pump discharge pressure for actuating the safety valve, the internal passages which establish communication between the pump unit and the safety valve are relatively small in volume and, therefore, it becomes necessary to employ an accumulator in order to provide sufficient liquid volume for developing immediate pressure to open said safety valve. Such accumulator, together with the structure required to conduct the pressure from the pump, then through a swivel or articulated joint, and finally to the safety valve, results in a complex and expensive assembly.

SUMMARY OF THE INVENTION

It is, therefore, one object of this invention to provide a submergible pump installation having a safety system including a subsurface safety valve which is not physically and directly connected to the pumping unit and which is controlled by a hydraulic actuating pressure, whereby the disadvantages inherent in physically and directly connecting the safety valve with the pumping unit are eliminated.

Another object of the invention is to provide a submergible pump installation including a hydraulically controlled subsurface safety valve wherein the hydraulic pressure which controls the valve is conducted to the valve from the exterior of the well pipe or tubing in which the pump is installed to thereby eliminate the complexity of conducting pressure to said valve through the interior of the pump unit housing.

A further object is to provide a subsurface safety valve for a submergible pump installation which is hydraulically actuated, either by the discharge pressure of the pump or by a pressure from some other source so that mechanical means is not depended upon to operate the valve, thereby making it possible to locate the valve at a substantial distance from the pump unit.

Still another object is to provide a submergible pump installation including an improved "annular" or poppet-type subsurface safety valve (as distinguished from the usual ball or flapper type valve) which is hydraulically actuated by suitable pressure either from the discharge side of the pump or from an outside source, with said valve being capable of being pressurebalanced to assure smooth and positive movement of said valve upon the application of actuating pressures; the valve being particularly adaptable for use where flow volumes are relatively low.

A particular object is to provide an improved annular or poppet-type subsurface safety valve for controlling the flow of fluid being pumped by a submergible pump assembly, which valve has means for equalizing pressures across said assembly to thereby facilitate running in and removal of the assembly from the well.

A further object is to provide an improved poppet-type valve which may be combined with the usual ball-type safety valve, said poppet valve being so constructed that it functions as an equalizing means to equalize pressures across the ball valve to facilitate operation of the ball valve with lower control pressures.

An important object is to provide a safety system of the character described, which permits a selection of primary and secondary safety valves for use in the system and in accordance with the particular well conditions, whereby only a single safety valve or a number of safety valves, some hydraulically actuated and some mechanically operated, may be used in the system.

BRIEF DESCRIPTION OF THE DRAWINGS

These and other objects and advantages of the present invention are hereinafter set forth and explained with reference to the drawings wherein:

FIG. 8 is a view, partly in section and partly in elevation of the hydraulically actuated ball type valve which is adapted to be connected to the lower portion of the poppet-type valve shown in FIGS. 7A–7C;

FIG. 10 is an enlarged sectional view of the valve seats which seal off flow through the poppet valve when it is in closed position;

DESCRIPTION OF THE PREFERRED EMBODIMENTS

Figure 1:
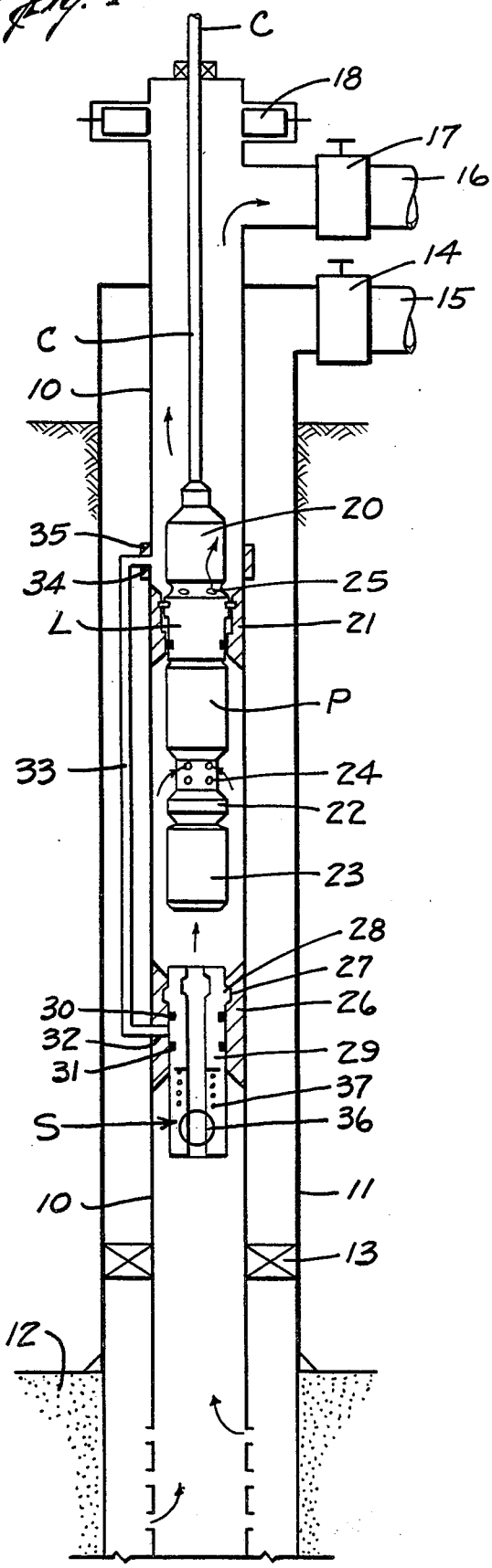
FIG. 1 is a schematic view of a pump installation with a hydraulically actuated ball type safety valve spaced below the pump and actuated by pump discharge pressure through a conductor located exteriorly of the well tubing in which the pump is mounted.

In the drawings (FIG. 1) a pump installation and safety system, constructed in accordance with the present invention is schematically illustrated. The usual well tubing 10 extends axially within the well casing 11 and conducts fluids from the producing formation 12 upwardly to the surface. The usual well packer 13 seals off the annular space between the lower portion of the tubing and the well casing while a surface control valve 14 controls flow from the casing through a side outlet 15. A similar side outlet 16 extends from the upper portion of the tubing and flow therethrough is controlled by a surface valve 17. At the upper end of the tubing, the usual blowout preventer 18 is mounted and arranged to close off the upper end of the tubing.

The pump installation which is schematically shown in FIG. 1 includes an electric pump P which is suspended on a cable C extending downwardly within the well tubing. The electric pump may be of any construction and includes a pump motor 20 which is directly connected with the cable C; the cable is a suspension cable which has both weight supporting and electrical power conducting capabilities.

For mounting the pump, motor and associated parts within the tubing, a pump shoe 21 is connected in the tubing string and is adapted to receive a lock and seal assembly L. The assembly L lands and locks within the shoe and both suspends and seals the pump in position. The particular submergible pump, the pump shoe 21 and the assembly L are all units which are available on the market and are distributed by the REDA Pump Division of TRW of Bartlesville, Oklahoma. The lower end of the pump P is connected through a ball or flex joint 22 with an accumulator chamber 23. The pump inlet 24 is at the lower end of the pump and its outlet 25 is just above the pump shoe. When the pump is operated, the well fluids are drawn upwardly into the intake 24 and discharged through the discharge ports 25 so that the liquid is pumped upwardly through the tubing string in the usual manner. The accumulator 23 is provided for the purpose of assuring that as soon as the pump starts its operation, there is a sufficient liquid volume to create a pressure at the discharge openings 25 of the pump. As will be explained, it is desirable with the installation of FIG. 1 to provide such immediate pressure upon the pump starting in operation.

Connected within the tubing string 10 at a point below the pump P is a conventional landing nipple 26. Such conventional nipple is well known in the art, one example of which is a "Type R Otis Landing Nipple" manufactured by the Otis Engineering Corporation of Dallas, Texas. The particular landing nipple illustrated has an internal profile or groove 27 which is adapted to coact with locking dogs 28 provided on a locking mandrel 29. The locking mandrel may be of the types identified as Types X and R, manufactured by the Otis Engineering Corporation and are modified to the extent of providing an upper sealing ring 30 and a lower sealing ring 31. When the locking mandrel is in position within the landing nipple, the seals 30 and 31 are disposed above and below a radial port 32 which extends through the wall of the landing nipple 26. The lower end of an external conductor 33 has connection with the port 32 and extends through the annular space between the tubing 10 and casing 11 with its upper end terminating in a connection with a port 34 formed in a collar 35 which is connected into the tubing string. The port 34 is located adjacent and just above the discharge end 25 of the pump P so that when the pump is operating, the discharge pressure of said pump is conducted downwardly through line 33 and through port 32 to the locking mandrel 29.

Figure 4:
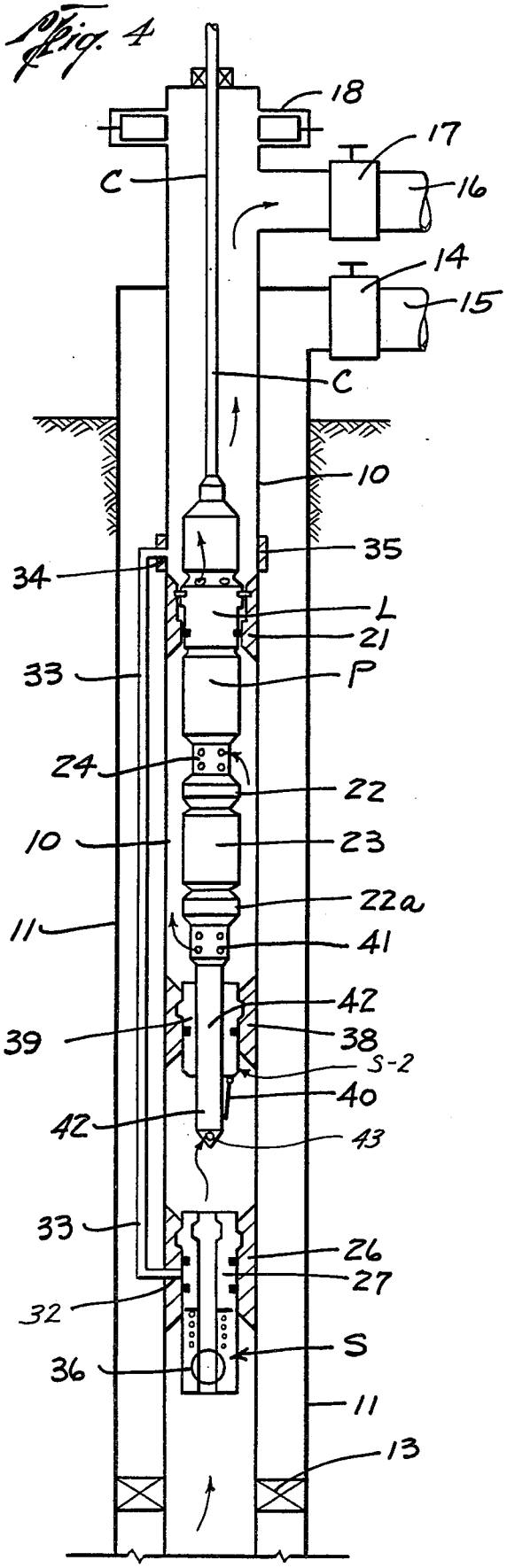
FIG. 4 is a view similar to FIG. 1, and showing a mechanically operated safety valve interposed between the pump and the ball type valve.

The locking mandrel has the conventional safety valve S secured thereto and depending therefrom. This safety valve, as shown in FIG. 4, includes a standard rotatable ball type valve 36 which is actuated through a piston controlled by the pressure in line 33. Since safety valves of this type are well known, reference is made to the Otis wireline-retrievable safety valves which are identified on page 5328 of the COMPOSITE CATALOG, 1978-1979 edition. The hydraulic pressure generated on the discharge side of the pump P is transmitted to the control piston of safety valve 36 and functions to maintain this valve in an open position as indicated in FIG. 1. When the pump discontinues operating, the pressure in line 33, conducted to the control piston of the valve 36, is reduced so that a spring schematically shown at 37 in FIG. 1 may rotate the valve to a closed position.

In the operation of the installation and the use of the safety system, the pump shoe 21, the landing nipple 26 and the ported collar 34 are connected in the tubing string. The conductor 33 extending from the discharge side of the pump to the nipple 26 is also connected to parts 32 and 34. The tubing string is then run in the hole in the usual manner and the packer 13 is properly set.

Thereafter, the locking mandrel having the hydraulically actuated safety valve 36 connected therewith is landed and locked in the landing nipple 26 in the conventional manner. The valve S is a normally closed ball safety valve which is opened by hydraulic pressure when such pressure is applied through the conductor 33 which, as has been noted, is located exteriorly of the well tubing.

The pump P and its associated parts are then lowered downwardly within the well tubing until the lock and seal assembly L enters and locks in and seals with the pump shoe 21. At this time, the safety valve S remains in its closed position. After the pump P is in the position illustrated in FIG. 1, its operation may begin and its discharge pressure will immediately act upon the safety valve S to open the ball type valve 36. The ball valve thus responds to the discharge pressure of the pump and so long as the pump is operating the valve will remain in its open position. When the pump is shut down for any reason, the ball valve 36, due to its design will automatically close. Thus, the pump and its associated parts may be readily withdrawn from the well and the safety valve 36 will close to maintain the well in a shut-in condition until the pump is returned to its landed position in the pump shoe and is again operated.

In prior installations the hydraulically actuated safety valve was connected physically and directly to the lower end of the pump assembly and the pressure necessary to open the valve was conducted downwardly through internal passages in said assembly. This provided for a complex arrangement because the pressure had to be conducted through the pump housing as well as downwardly past the flex joint 22. Other structures, such as that shown in U.S. Pat. No. 4,121,659 separated the landing nipple and the safety valve from the pump but required an actual, direct physical contact between the pump assembly and the valve in order to open it. In this latter case, the valve was mechanically operated by a depending prong which, of course, limited the distance between the pump assembly and the safety valve.

As will be readily seen from the foregoing description of FIG. 1, the distance between the safety valve S and the pump P is subject to considerable variation. There are no passages through the pump housing or through any of the other parts of the assembly for the purpose of conducting fluid pressure to the safety valve S. Instead, the pressure fluid is conducted downwardly to said safety valve through the conductor 33 which is located exteriorly of the well tubing. It is therefore possible to provide a hydraulically actuated safety valve which responds to pump operation without providing a direct physical connection between the safety valve and the pump assembly.

Figure 2:
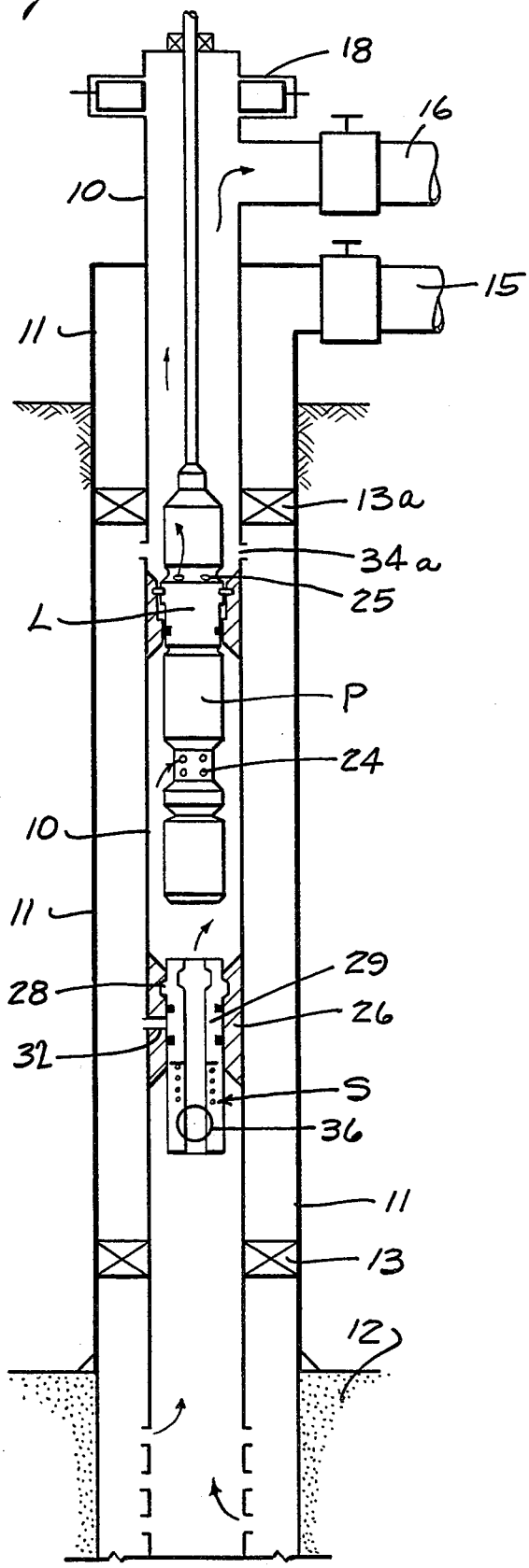
FIG. 2 is a similar view in which the annulus between the well casing and the well tubing is utilized for conducting pressure to the safety valve.

Referring next to FIG. 2, this Figure illustrates a slight modification to the assembly shown in FIG. 1. Instead of providing the exterior conductor 33 of FIG. 1, the structure is modified to omit the conductor 33 and the ported collar 35. In place thereof, a second packer **13*a* is set between the tubing 10 and the casing 11 at a point above the discharge end 25 of the pump P. A collar 34*a* having a plurality of ports 35*a* establish a communication between the interior of the tubing and the casing. The discharge pressure from the pump may pass through these ports 35*a* and into the annulus between the tubing and the casing and in the area between the packers 13 and 13*a*. Obviously, this annular space substitutes for the conductor 33 and transmits discharge pressure from the pump to the port 32 in the landing nipple 26** of the safety valve S.

The operation of the form illustrated in FIG. 2 will be identical to that previously described with the only difference being that the annulus provides the communication between the pump discharge and the safety valve instead of the conductor 33 shown in FIG. 1. The safety valve S may be located at any distance below the pump assembly and there is no requirement that there be any type of direct physical connection or contact between said valve and said pump assembly.

Figure 3:
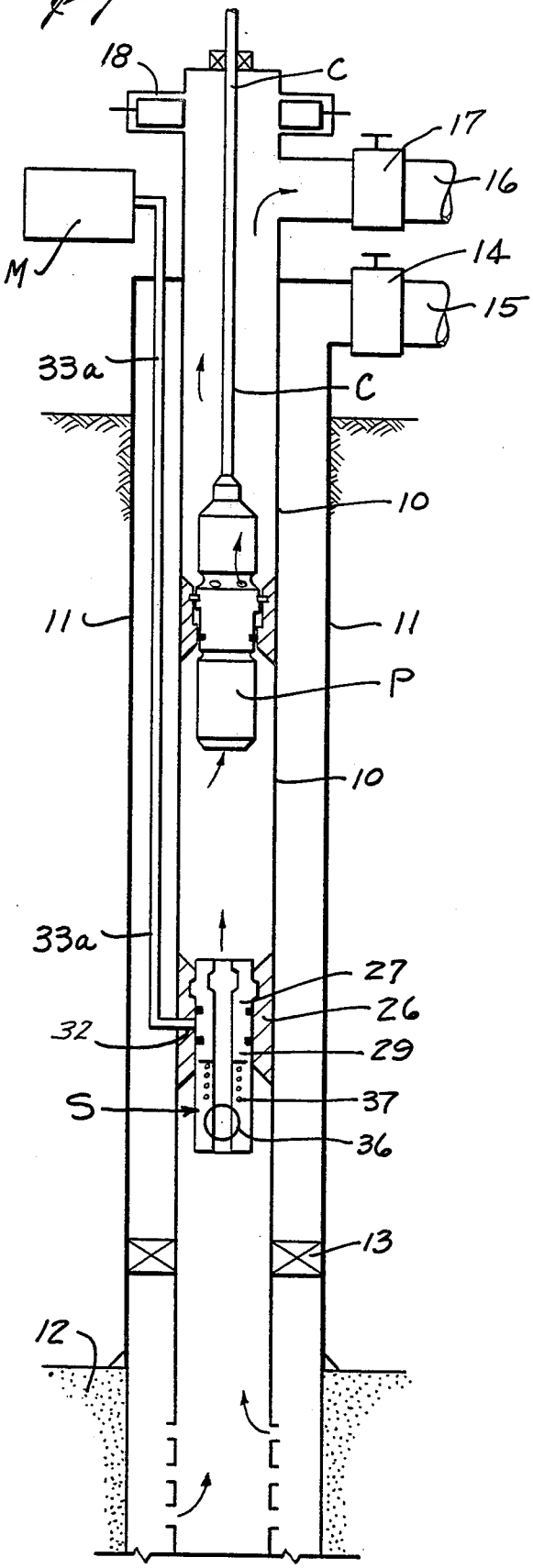
FIG. 3 is a view, similar to FIG. 1, wherein the operating pressure is conducted to the safety valve from the surface.

There may be instances where it becomes desirable to control the safety valve from the surface of the well and FIG. 3 illustrates such an installation. A surface controlled manifold M is located at the surface and a conductor **33*a* extends from said manifold downwardly through the annulus between tubing 10 and casing 11 to the port 31 which is located in the landing nipple 26. In this instance, the ported collar 34 is omitted since there is no need to conduct pump discharge pressure to the safety valve S. The operation of this installation is similar to that of the installations in FIGS. 1 and 2** with the exception that the safety valve is responsive, not to the discharge pressure of the pump, but to the control pressure at the surface.

In certain installations, it may be desirable to provide a second or back-up valve, commonly referred to as a foot valve, in addition to the safety valve S. This would assure that when the pumping assembly is out of the tubing and the safety valve S is closed, any leak developed by such safety valve would be prevented by the use of such foot valve. Such installation is illustrated in FIG. 4. As shown in this FIG. 4, the landing nipple 26 which coacts with the locking mandrel 27 and ball valve 36 is spaced a greater distance below the pump shoe 21 in which the pump P is landed. By providing this additional space, it is possible to locate a foot valve designated S-2 between the pump assembly P and the first safety valve S. The foot valve includes a landing nipple 38 which is connected in the tubing string 10. The landing nipple 38 is adapted to receive a safety valve locking mandrel 39 which provides a valve body, and the foot valve of this unit is a pivoted flapper valve member 40. Flapper type safety valves are in common use and are offered by several companies including the Otis Engineering Coporation, with one example of such valve being the Type QO valve which Otis offers to industry. Since the flapper vlave is spring closing, it is constantly in a closed position and requires an actual mechanical motion to move it to an open position.

The pumping unit assembly of FIG. 4 is modified as compared to the assembly of FIG. 1 by adding a second flex joint **22*a* below the accumulator 23. Below said second flex joint is a perforated pipe 41 from which projects a depending tubular prong 42 having inlet openings 43** at its lower end.

The spacing of the parts and particularly of the depending prong 42 on the pump assembly is such that when the pump is landed and sealed in the pump shoe 21, said prong extends downwardly through the bore of the valve body 39, engages the pivoted flapper valve 40 and swings it to an open position as shown in FIG. 4. Thus, the positioning of the pump assembly within the pump shoe will properly locate the prong 42 and swing the flapper valve to its open position.

The operation of the installation of FIG. 4 is believed to be obvious. Landing of the pump assembly in proper position within the pump shoe swings the flapper 40 of the foot valve to an open position and at this time the hydraulically actuated safety valve S is in its closed position. However, as soon as pump P begins to operate, the discharge pressure of the pump is conducted downwardly through the line 33 and acts upon safety valve S open the valve 36. Therefore, positioning of the pump opens the flapper 40 of the foot valve S-2 and pump operation develops the necessary pressure to open the ball valve 36 so that liquids can be pumped to the surface. When the pump stops operating, pressure on the lower safety valve S is relieved and the ball valve 36 is returned to a closed position. Removal of the pump assembly will remove the depending prong 42 from the foot valve assembly S-2 and allow the flapper 40 of the said valve to be swung by spring force to its closed position. Thus when the pump is removed from the well, the two valves close to assure that the well is maintained under control.

It might be noted in connection with the assembly of FIG. 4 that two flex joints are shown and these are provided for the purpose of assuring that the pump assembly, which has increased length because of the prong, can move downwardly through various curves or bends in the tubing.

In FIGS. 1 through 3, the particular safety valve which is schematically illustrated is well known and in general use and involves a rotating ball valve member. The rotating ball safety valve is particularly adaptable for use under high flow volume conditions and will be preferable in such enviroment. However, flapper type or other type safety valves, such as those described in U.S. Pat. No. 3,273,588 may be substituted for the ball type and will operate effectively without requiring any direct physical connection with the pumping unit.

In some instances, as where flow volumes are low, an annulus or poppet-type valve may be more desirable and one such type of safety valve, SA, is shown in FIGS. 5, 7A, 7B, 7C and 10. As used herein, the terms "poppet-type valve" or "annulus valve" means a valve in which the closure is effected by relative longitudinal movement of two tubular members, each of which has a sealing surface engageable with the sealing surface of the other member.

The poppet-type valve is easily pressure balanced so that reduced control pressure is required to open the valve, as compared to the ball type valve. Also, poppet valves are particularly adaptable for use with an elastomeric to metal seal because the engaging surfaces forming the seal move longitudinally or axially with respect to each other to open and close the valve. In the ball type valve, elastomeric seals are subject to damage because of the rotative movement of the ball as it moves from one position to the other.

Figure 5:
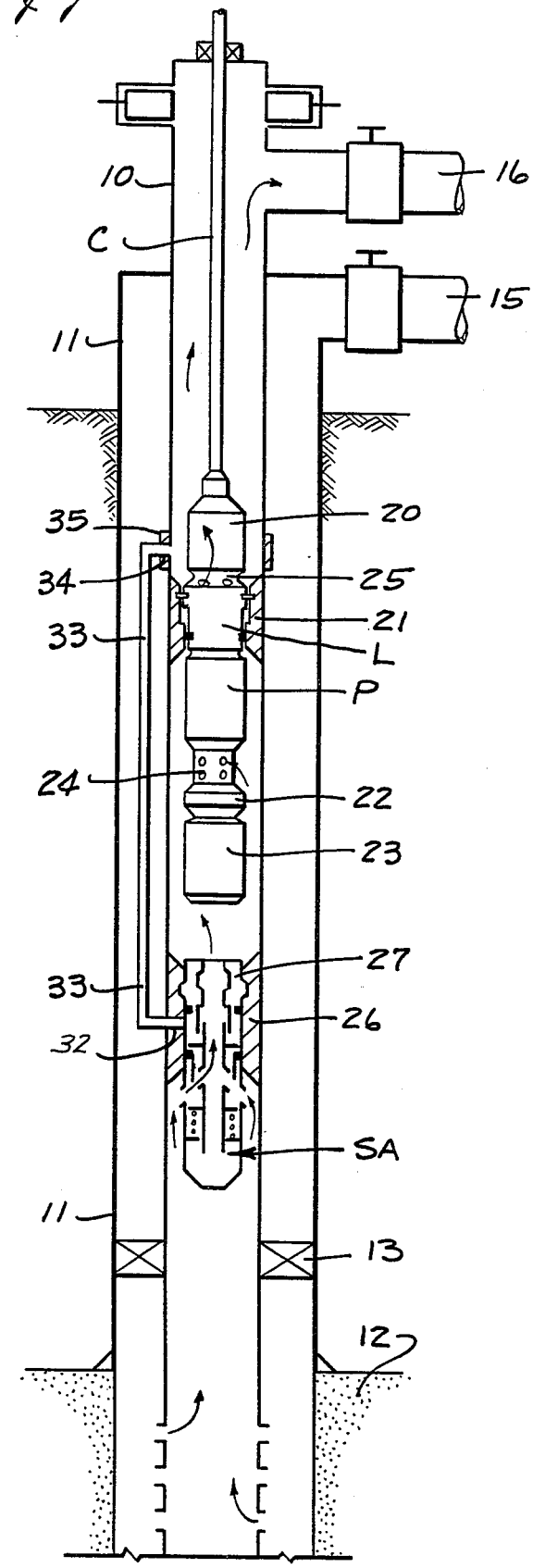
FIG. 5 is a schematic view substantially the same as FIG. 1, excepting that a poppet-type valve is substituted for the ball type valve, with pump discharge pressure actuating said valve.

Referring specifically to FIG. 5, the pressure is conducted to the poppet-type safety valve SA through the conductor 33 whereby said valve is responsive to the discharge pressure developed by pump P. As will appear more clearly from the detailed description, the operation of the poppet type safety valve has substantially the same basic operation as all safety valves. It is open so long as there is pressure applied to its piston element and it automatically closes when such pressure is relieved.

Figure 6:
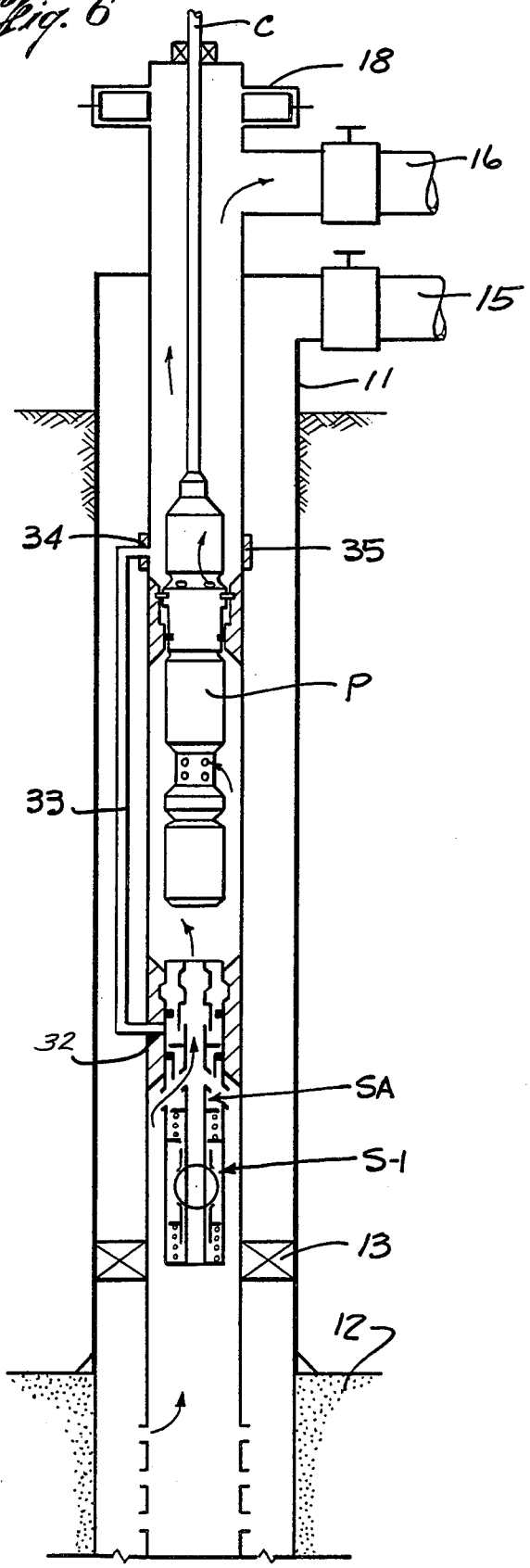
FIG. 6 is a view substantially the same as FIG. 5 but showing the poppet-type valve combined with a ball type valve.

In FIG. 6, the annular valve SA is shown combined with the rotatable ball type safety valve S-1 to provide dual safety valves when the pump assembly is removed. This combination is capable of accommodating high flow rates which are possible with a submergible pump.

Figure 7A:
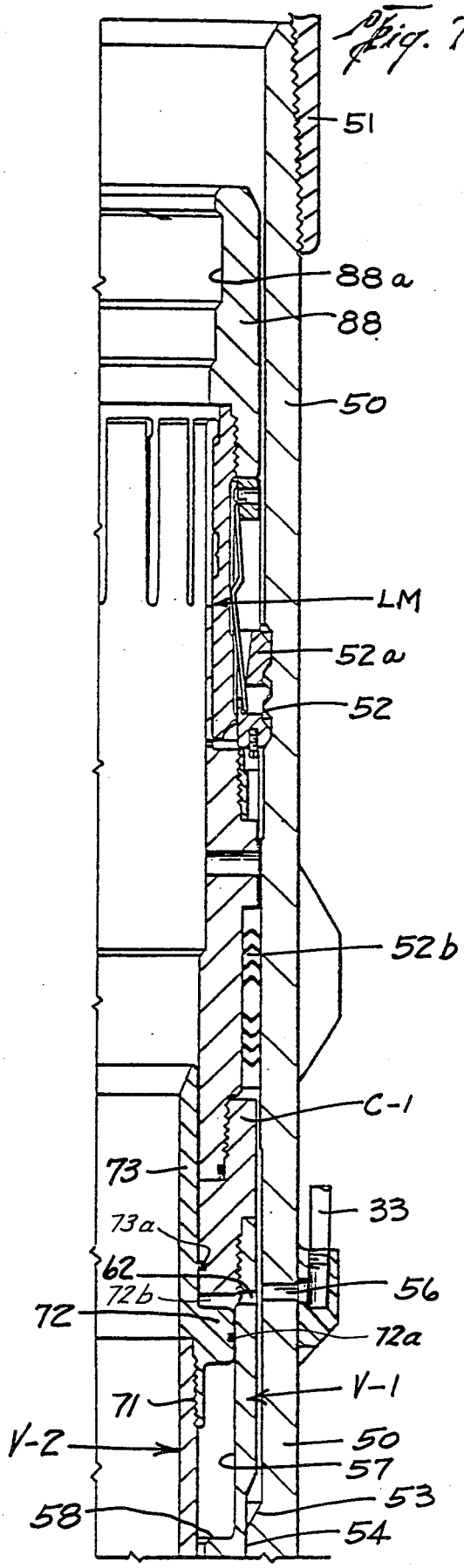
FIG. 7A is a quartersection sectional view of the upper portion of the poppet-type safety valve with said valve in closed position.
Figure 7B:
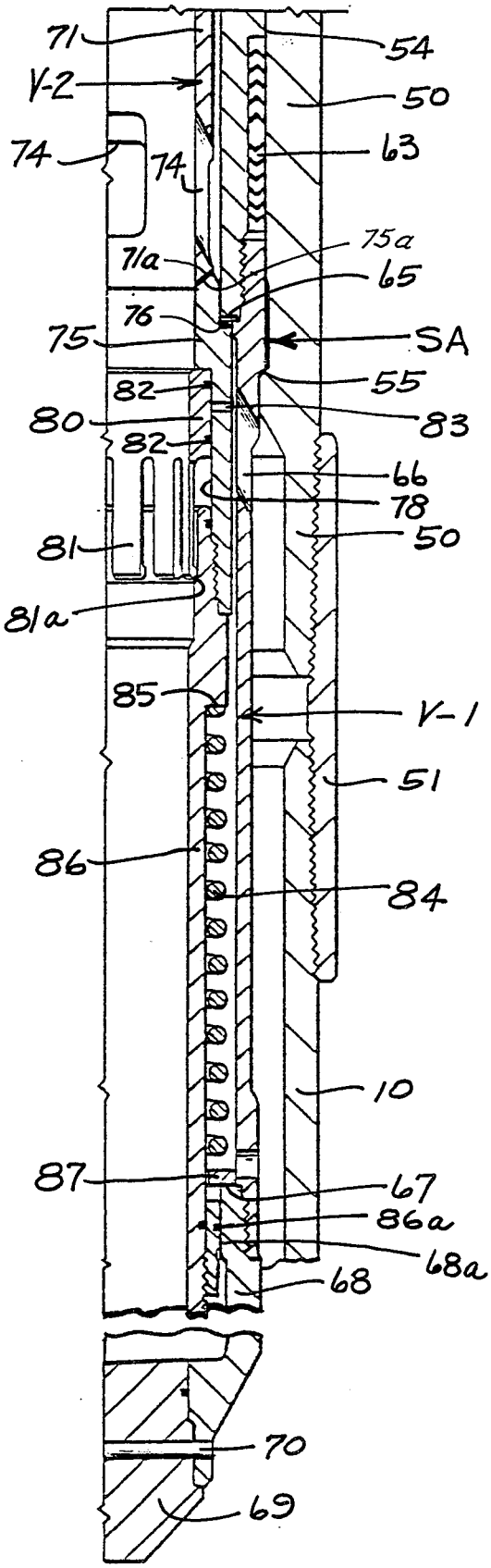
FIG. 7B is a continuation of FIG. 7A showing the lower portion of the valve with the valve in a closed position.

In FIGS. 7A, 7B, 7C and 9, the poppet-type valve SA is illustrated in detail. Referring to FIGS. 7A and 7B, the usual type of landing nipple 50 comprises an elongate tubular body which is connected by couplings 51 in the tubing string 10. Within the upper portion the bore of said landing nipple, the usual profile of annular grooves 52 is formed for receiving the keys **52*a* of a locking mandrel LM. A suitable packing assembly 52*b* is carried by the body of the locking mandrel and seals with the bore of the landing nipple. Spaced below the grooves 52, the bore of the landing nipple is formed with an internal annular shoulder 53 which reduces said bore as indicated at 54. A second smaller shoulder 55 is formed in the bore 54** and functions as a stop shoulder to properly locate the valve and its locking mandrel within the landing nipple.

The body 50 of the landing nipple is formed with an angular inlet port 56 which communicates with the bore of the body at a point above the upper shoulder 53. The outer portion of the port 56 has connection with the conductor 33 which conducts the pressure into the bore of the landing nipple and as will be explained, into the valve for actuation of said valve.

The valve is of the poppet type, as distinguished from a rotating ball type and is adapted to be lowered into the well and removed therefrom by the locking mandrel LM. The upper end of the valve is connected to the lower portion of tubular body of the locking mandrel by a coupling C-1. The mandrel is run on the usual wireline equipment which is commonly used and well known in the well industry.

Figure 7C:
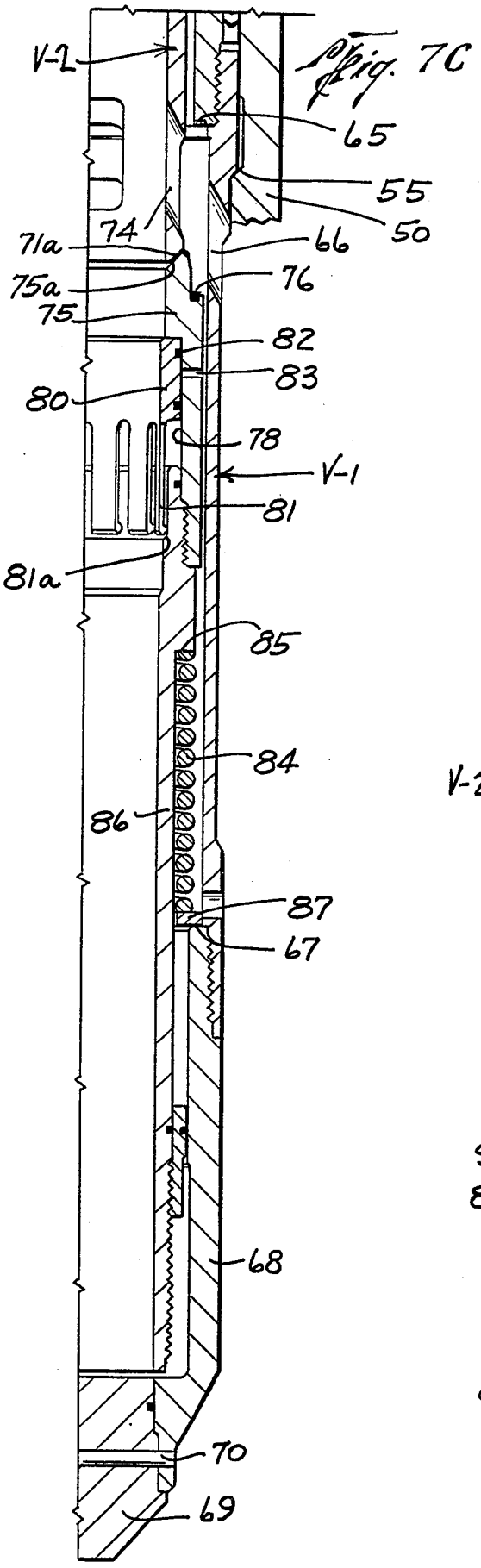
FIG. 7C is a view, similar to 7B, and illustrating the valve in open position.

As shown in FIGS. 7A, 7B, and 7C, the valve comprises an outer main valve section V-1 and an inner valve section V-2. The outer valve section includes a tubular body having a cylinder 57 at is upper end, with the bore of the cylinder being enlarged with respect to the bore through the upper portion of the valve body to provide an upwardly facing shoulder 58. The upper end of the cylinder 57 is connected through the coupling C-1 with the body of the locking mandrel LM and has a radial port 62 (FIG. 7A) which communicates through the angular port 56 with the conductor 33, whereby actuating pressure may be introduced into the upper end of said clyinder. A suitable sealing assembly 63 (FIG. 7B) surrounds the exterior of the body of the valve section V-1 and provides a seal between said body and the bore of the landing nipple when the valve is in position within the said nipple.

Below the seal 63 the bore of the body of the valve section V-1 is formed with a downwardly facing internal annular seating surface 65 which is preferably a hard faced weld which resists corrosion (FIG. 10). Below the seating surface 65, a plurality of inclined flow openings 66 are formed in the wall of the body V-1 and communicate with the interior of the tubing 10. The outer valve section V-1 extends some distance downwardly below the flow openings 66 and an internal annular shoulder 67 is provided at a point spaced above the lower end of this section (FIG. 7B). For purposes of assembly, the outer valve section V-1 is made up of several members which are threaded together and the lower portion of said section includes a tubular element or end piece 68, the upper end of which forms the shoulder 67. The lower end of the bore 68*a* of the element 68 is closed by a plug 69 which is held in place by a frangible pin 70 which may be sheared when it is desired to remove said plug.

The inner valve section V-2 comprises an elongate sleeve or tube 71 which has a piston 72 secured to its upper end (FIG. 7A). The piston 72 has an O-ring 72*a* sealing with and movable within the cylinder 57 of the outer valve section V-1 and has an upwardly extending tubular extension 73 which not only functions as a guide during movement of the inner valve sleeve V-2, but also has a sliding seal with an O-ring 73*a* mounted within an annular groove in the bore of the coupling C-1. The space between the upper end of piston 72 and the lower end of coupling C-1, sealed off by O-rings 72*a* and 73*a*, communicates with the pressure port 62 and forms a variable volume chamber 72*b*. The wall of the sleeve of the the inner valve section is provided with a plurality of flow openings 74 spaced downwardly from the piston 72 (FIGS. 7B and 7C) and said openings are similar to the flow openings 66 formed in the body of the outer valve section. With the piston 72 in its upper position, the flow openings 66 and 74 are misaligned, as shown in FIG. 7B.

Below the sleeve of the inner valve section V-2 is a valve seat assembly 75 which has an upwardly facing, external annular shoulder 77 (FIG. 10). This shoulder or surface preferably has an annular elastomeric sealing element 76 mounted thereon and said element is adapted to engage the seating surface 65 of the outer section V-1 of the valve. This arrangement forms a poppet-type valve which assures a positive seal when the valve is closed.

The seat assembly of the tubular valve section V-2 is formed with an enlarged counterbore 78 within which an equalizing valve collar 80 is slidable. Normally, the collar 80 is in the position shown in FIG. 7B, abutting the upper end of the counterbore and held so by flexible finger elements 81 which engage an internal shoulder 81*a* of a downwardly projecting extension 86 threaded onto the lower end of the valve assembly 75. The equalizing collar 80 has spaced external seal rings 82 which are disposed on each side of a radial port 83 extending through the wall of the valve assembly 75. When the collar 80 is in the position shown in FIG. 7B, the port 83 is closed but when said collar is moved downwardly, the bore of the outer valve section V-1 may communicate with the bore of the inner valve section V-2 and interior and exterior pressures across the valve are equalized.

The upper inclined surface 75*a* of the valve seat assembly 75 is held in engagement with the lower inclined surface 71*a* of the inner valve section V-2 by a coil spring 84. The upper end of the spring engages a downwardly facing external shoulder 85 on the tubular extension 86 which forms the lower portion of the valve seat assembly 75. The lower end of the spring 84 contacts a bearing ring 87 which is supported upon the internal shoulder 67 of the tubular end piece 68 at the lower end of the outer valve section V-1. A pressure balancing ring 86*a* is interposed between the exterior of the extension 86 and the end piece 68 and is sealed therewith by sealing rings 86*b*. The area of the ring is related to the area of seating surface 76 and 65 and function to balance the pressure acting on such surfaces.

The spring 84 exerts its force upwardly against the valve seat assembly 75 to urge said assembly 75 and the inner valve section V-2 upwardly to maintain the elastomeric sealing element 76 in sealing engagement with the seating surface 65. This is the closed position of the valve and is shown in FIGS. 7A and 7B. When the valve is closed, the piston 72 on the inner valve section V-2 is in its upper position within the cylinder 57 of the valve section V-1.

In the operation of the valve, after the parts are positioned within the well tubing in the manner shown in FIGS. 7A and 7B, the pressure is built up within the conductor 33 and is applied to the upper end of the annular piston 72. When the force of control fluid pressure acting on piston 72 exceeds the force of the spring 84, the inner valve section V-2 and its seating assembly 75 are moved downwardly to the position shown in FIG. 7C. In such position, the elastomeric sealing element 76 and seating surface 65 of the valve sections V-1 and V-2 are disengaged and the poppet-type valve formed by said element and said surface is in an open position. So long as the pressure in the conductor 33 is maintained, the parts will be held in the position of FIG. 7C and fluid may flow upwardly from the lower portion of the tubing through the openings 66 and 74 and then upwardly within the well tubing. If for any reason pressure is lost in conductor 33, as for example when the pump P is discontinued in its operation or for other reasons, the spring 84 will return the parts to the position shown in FIGS. 7A and 7B to automatically close the valve.

During normal operation and after the valve is in position within the well, the equalizing valve 80 within the counterbore 78 of the valve assembly 75 prevents flow through the equalizing port 83 and remains in the position shown in FIGS. 7B and 7C. However, during the time that the valve is being run into the well or removed from the well it is desirable that pressures interiorly and exteriorly of the valve be equalized and this may be accomplished by said equalizing valve.

Figure 9:
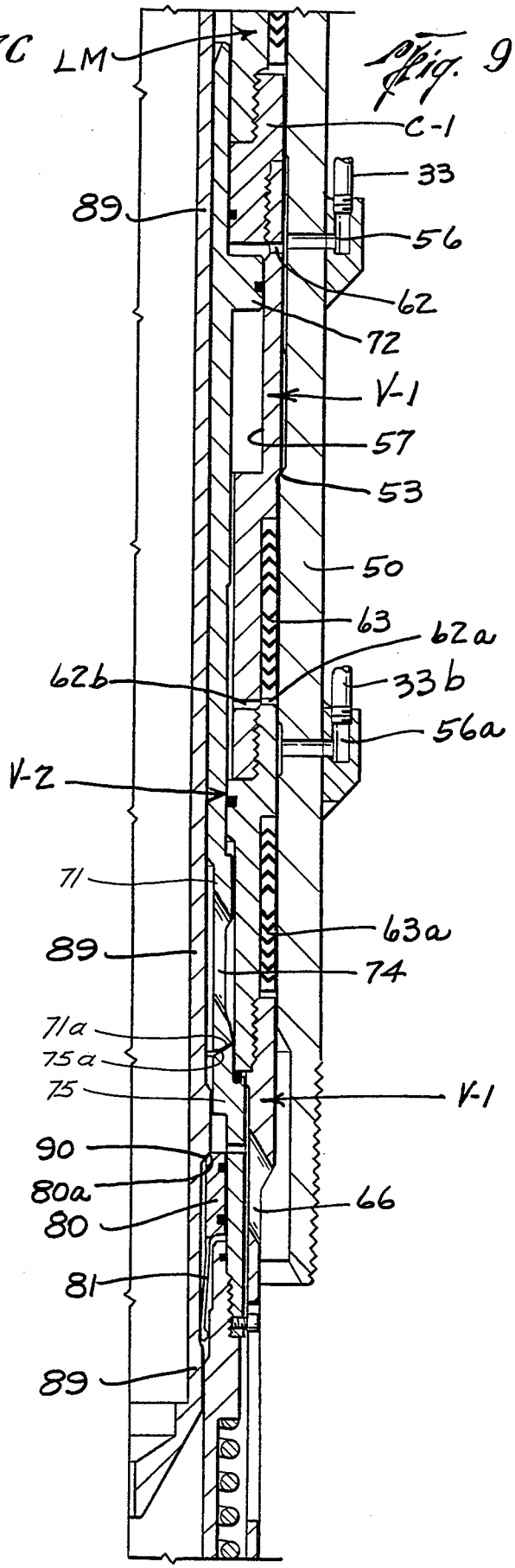
FIG. 9 is a quartersection sectional view illustrating the connection of a pressure balancing line to the poppet-type valve of FIGS. 7A–7C.

To accomplish this, the equalizing collar 80 is moved downwardly so that the equalizing port 83 may equalize pressures between the bores of the main valve sections V-1 and V-2. Such movement of collar 80 is effected by providing a downwardly projecting prong or extension 89 (FIG. 9) on the standard types of running and pulling tools. As is well known, the standard running and pulling tools engage the annular recesses 88*a* in the fishing neck 88 (FIG. 7A) which is provided at the upper end of the locking mandrel LM. As shown in FIG. 9, a running or pulling tool need only have the prong or extension 89 formed with an external shoulder 90 which will engage the beveled upper end 80*a* of the equalizing collar 80 and by properly spacing said external shoulder, the equalizing collar will be moved downwardly just prior to the time that the running or pulling tool will engage the recesses 88*a* of the fishing neck 88 of the assembly. In this way, the tool can be run into the well or removed therefrom with pressure around the tool fully equalized.

The particular advantage of the poppet-type valve heretofore described (and shown schematically in FIG. 5) is that a larger volume of liquid may move through the poppet valve as compared to a ball valve sized for the same diameter of tubing. Also, poppet valves may be operated by a considerably lower pressure than is required for the normal ball type safety valve. In the ball type valve, large forces are caused by a pressure differential across a large unbalanced seal area of the ball and require higher control fluid opening pressures. The provision of the annular seating surface 65 and the elastomeric sealing element 76 which form a poppet-type of valve assure a positive seal when the valve is closed. The area of the seal defined by 76 and 65 is balanced by the area of the outer seal 86*a* operating in sealing bore 68*a*. Seating and unseating of said sealing elements presents little resistance to movement of valve section V-2.

Figure 11:
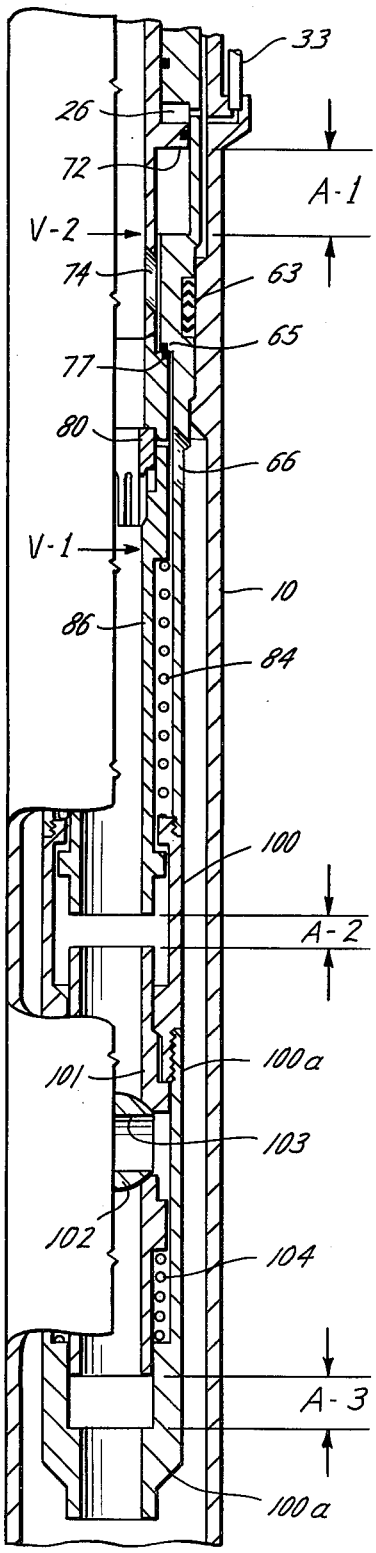
FIG. 11 is a diagrammatic view illustrating the combination of the poppet valve of FIGS. 7A and 7B with the ball type valve shown in FIG. 8, with specific details of structure omitted for the sake of clarity.
Figure 12:
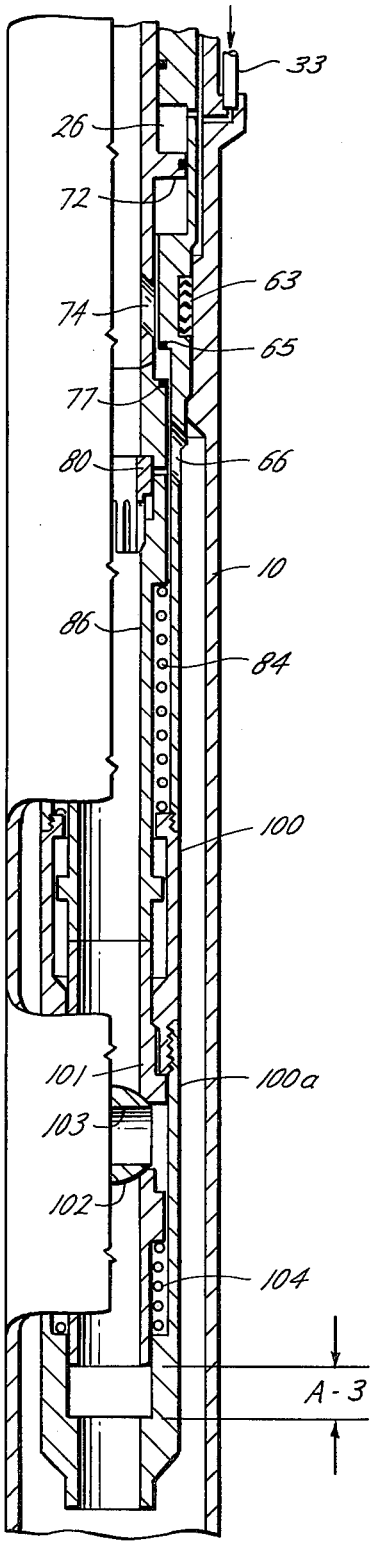
FIG. 12 is a view similar to FIG. 11 with the poppet valve open to equalize pressures across the ball valve prior to opening of the latter.

Experience has shown that although the annular or poppet-type valve has certain advantages with respect to operating at the lower pressures, it may not be totally satisfactory where flow volumes are exceptionally high. However, where flow volumes increase, the annular or poppet valve disclosed herein lends itself to a combination with the usual rotating ball type valve which is shown in FIG. 8. FIGS. 11 and 12 illustrate the poppet valve combined with the ball type.

Referring specifically to FIGS. 8, 11 and 12, the lower end piece 68 of the valve heretofore described is replaced by a coupling 100 which connects the valve shown in FIGS. 7A and 7B with the outer tubular body 100*a* of the usual or well known rotating ball type safety valve. Such valve includes the tubular actuating piston 101 which is slidable within the bore of the body and which is urged to the upper position as shown in FIG. 8 by a spring 104. Upon movement of the actuating piston in a downward direction against the spring force rotation is imparted to the ball valve 102 through the usual pin and groove connection 102*a*.

In the position shown in FIG. 8, a passage 103 extending through the ball is misaligned with the bore through the body 100 and flow into the tubing above said body cannot occur. At such time, the valve is closed with the surface of the ball sealing against the annular seat 103*a* formed in the actuating piston. When the actuating piston moves downwardly within the body 100*a*, the ball is rotated so that the passage 103 through said valve is aligned with the bore through the tubing to which the valve is connected. To impart downward movement to the tubular actuating piston, such piston is aligned with the extension 86 of the annular or poppet valve, whereby as downward movement of said extension occurs to open said poppet valve, the ball valve is also opened.

When pressure is applied through the conductor 33 to the piston 72, both valves are opened and will remain so long as said pressure is applied. When pressure in the conductor is reduced, both valves are closed by their respective spring forces. Thus, a double valve for protection purposes is provided and a relatively high volume of fluid can be handled.

In FIGS. 11 and 12, the combination of the poppet-type valve with the ball-type valve is illustrated diagrammatically. Certain portions and details of the structures, which are fully shown in FIGS. 7A, 7B and 8, have been omitted in order to illustrate the sequential operation which occurs when the poppet valve is coupled to the ball-type valve through the coupling 100.

Referring specifically to FIG. 11, when both valves are in a closed position, the piston 72, which is moved downwardly by control pressure being conducted to its upper surface through the conductor 33, is at the upper end of its travel. The total travel of piston 72 is designated by the space between the lines A-1. At the time that piston 72 of the poppet valve is in the position of FIG. 11, said valve is closed by the engagement of sealing ring 76 with the sealing surface 65, and the lower end of the extension 86 of said poppet valve is spaced upwardly from the actuating piston 101 of the ball valve. This space between the lines A-2 is considerably less than the total travel of piston 72 and its associated valve parts. Upon the extension 86 of the poppet valve engaging the actuating piston 101 and continuing its downward movement, the piston moves sufficiently to rotate the ball valve to its open position. The actuating piston 101 can be moved for a distance designated by the space between the lines A-3. The space, like space A-2, is lesser than the space between the lines designated A-1.

In operation, with the parts in the position shown in FIG. 11, control pressure is conducted downwardly through the line 33 to the upper end of piston 72 of the poppet valve. As the valve members V-1 and V-2 of the poppet vlave move downwardly against the force of the spring 84, the lower end of the extension 86 of said valve engages the upper end of the actuating piston 101 of the ball-type valve. This position of the parts is shown in FIG. 12, and at this time, the poppet valve is open, while the ball-type valve is still in a closed position. By reason of the poppet valve opening, pressure from below the ball valve may flow upwardly through the tubing and into the interior of the poppet valve whereby the pressures above and below the ball valve are at least partially, if not completely, equalized. With these pressures equalized across the ball valve, the force required to open said ball valve is substantially reduced.

Continued application of pressure to the piston 72 of the poppet valve rotates the ball valve 102 to align its opening 103 with the bore of the assembly. This sequential opening of the two valves allows the opening of the lower ball-type valve with a relatively smaller force than that which would otherwise be required in this type of valve. The same would be true if the poppet-type valve were combined with a flapper valve to effect equalization of pressures across such flapper valve. It might be noted that ball valves and flapper valves are the most common types now used for well tubing safety valves, primarily because they fit the tubular configuration of the well and permit a straight-through flow.

The sequential operation of opening the poppet valve, pressure equalization and opening of the ball valve is accomplished by controlling the length of travel of the operating elements. The length of travel of the actuating piston 72 of the poppet valve must be sufficient to allow the tubular extension 86 of the poppet valve to travel through the space A-2, during which pressure equalization occurs and to thereafter travel far enough to move the actuating piston 101 through the space A-3 and assure opening of the ball-type valve.

In certain instances, it is desirable to locate the pump as deep as possible and in some cases, the hydrostatic head present in the well might affect the operation to the extent that sufficient pressure cannot be applied through the conductor 33 to properly actuate the valve. If this situation is present, the structure may be modified as shown in FIG. 9 wherein a separate balancing line 33*b* is provided. The pressure conducted through both the operating or control line 33 and the balancing line 33*b* would necessarily have to extend from the surface of the well because accurate control of the pressure in each line would not be possible if both lines were connected to the pump.

To utilize the balancing line it is necessary to provide an aditional set of packing 63*a* around the outer valve section V-1 and such packing is spaced downwardly from the packing 63 of the first form. A second angular port 56*a* communicates with the space between the packings 63 and 63*a* and with a radial openings 62*a* and 62*b* which communicate with the bore of valve section V-1 and then with the underside of the actuating piston 72. Thus, by controlling the pressures in lines 33 and 33*b*, pressures on each side of the actuating piston may be controlled. By so controlling these pressures, it is possible to properly actuate the valve regardless of the hydrostatic head pressure.

What is claimed is:

1. A submergible pump installation for a well having a tubing therein including a landing nipple comprising, a submergible pump having a lower intake and an upper discharge, said pump run in said tubing on means providing communication with the surface, means for mounting and sealing the pump within the tubing, said sealing means being located between the intake end and the discharge end of said pump whereby when the pump is operating, well fluid is pumped into said intake and is discharged from said discharge end, a subsurface safety valve having hydraulically-actuated means for controlling operation thereof, means for independently mounting and sealing said safety valve within the tubing at a point spaced below and having no direct physical connection with the submergible pump other than through the tubing, said valve controlling flow to the inlet of said pump, and means for conducting pressure fluid to the hydraulically-actuated means of said valve to operate said means and maintain said valve in open position when the pump is operating, said valve remaining in the tubing to prevent flow therethrough when the pump is pulled.

2. A submergible pump installation as set forth in claim 1, wherein the pressure fluid which is conducted to the hydraulically-actuated means of the subsurface safety valve is the discharge pressure from the pump.

3. A submergible pump installation as set forth in claim 1, wherein the pressure fluid which is conducted to the hydraulically-actuated means of the subsurface safety valve is conducted from a source at the surface of the well.

4. A submergible pump installation for a well having a tubing therein including a landing nipple comprising, a submergible pump having a lower intake and an upper discharge, said pump means run in said tubing on means providing communication with the surface, means for mounting and sealing the pump within the tubing, said sealing means being located between the intake end and the discharge end of said pump whereby when the pump is operating, well fluid is pumped into said intake and is discharged from said discharge end, a poppet-type subsurface safety valve having hydraulically-actuated means for controlling operation thereof, means for independently mounting and sealing said safety valve within the tubing at a point spaced below and having no direct physical connection or contact with the submergible pump other than through the tubing, said valve controlling flow to the inlet of said pump, and conductor means extending from the discharge end of the pump exteriorly of said tubing to the hydraulically-actuated means of the subsurface safety valve for conducting pressure fluid to the valve to thereby operate the valve to maintain it in a open position when the pump is operating, said valve remaining in the tubing to prevent flow therethrough when the pump is pulled.

5. A submergible pump installation as set forth in claim 1, wherein the subsurface safety valve comprises an outer housing, an outer tubular valve section within said housing, an inner tubular valve section mounted for longitudinal movement within said outer section, and said inner and outer valve sections having means which allows flow of well fluids to the pump when the sections are in one position relative to each other, and engageable seals on said sections for shutting off flow through said last named means when the seals are engaged and the sections are in a second position.

6. A submergible pump installation as set forth in claim 1, wherein the subsurface saftey valve comprises an outer housing, an outer tubular valve section within said housing, an inner tubular valve section mounted for longitudinal movement with said outer section, and said inner and outer valve sections having means which allows flow of well fluids to the pump when the sections are in one position relative to each other, engageable seals on said sections for shutting off flow through said last named means when the seals are engaged and the sections are in a second position, and said hydraulically-actuated means for controlling operation of said subsurface valve forms a part of the inner and outer valve sections and is exposed to the pressure fluid which operates said hydraulically-actuated means.

7. A submergible pump installation as set forth in claim 1, wherein the subsurface safety valve comprises an outer housing, an outer tubular valve section within said housing, an inner tubular valve section mounted for longitudinal movement within said outer section, said inner and outer valve sections having means which allows flow of well fluids to the pump when the sections are in one position relative to each other, engageable seals on said sections for shutting off flow through said last named means when the seals are engaged and the sections are in a second position, a second subsurface safety valve means disposed below and connected with said first subsurface safety valve, and coacting means between the first subsurface safety valve and said second valve means for opening the second valve means when the first valve means is open to permit flow, said coacting means closing said second valve means when the first valve is closed.

8. A submergible pump installation as set forth in claim 1, wherein the subsurface safety valve comprises an outer housing, an outer tubular valve section within said housing, an inner tubular valve section mounted for longitudinal movement within said outer section, said inner and outer valve sections having means which allows flow of well fluids to the pump when the sections are in one position relative to each other, engageable seals on said sections for shutting off flow through said last named means when the seals are engaged and the sections are in a second position, a second subsurface safety valve means disposed below and connected with said first subsurface safety valve, said first and second safety valves having their outlets in fluid communication, said second safety valve means comprises a rotating ball member having a passage therethrough, whereby rotation of the ball will move it from one position shutting off flow, to a second position which permits flow therethrough.

9. A submergible pump installation for a well having a well casing and a well tubing therein including a landing nipple comprising, a submergible pump having a lower intake and an upper discharge, said pump run in said tubing on means providing communciation with the surface, means for mounting and sealing the pump within the well tubing, said sealing means being located between the intake end and the discharge end of said pump whereby when the pump is operating, well fluid is pumped into said intake and is discharged from said discharge end, a first subsurface valve having hydraulically-actuated means for controlling operation thereof, means for independently mounting and sealing said first valve within the well tubing at a point spaced below and physically disconnected from the submergible pump other than through the well tubing, means for conducting pressure fluid to the hydraulically-actuated means of said first subsurface valve to selectively open and close said valve, a second subsurface valve which is in a normally closed position, means for independently mounting and sealing said second valve within the well tubing at a point between the pump and the first valve, and a downwardly extending prong secured to the pump and adapted to engage the second vlave to mechanically move it to an open position when the pump is mounted within the well tubing, whereby said second valve is open so long as the pump is in place within the casing but is closed by removal of the pump and its downwardly extending prong from the well, said first and second valves controlling flow to the inlet of the pump and remaining in the well when the pump is pulled.

10. A submergible pump installation as set forth in claim 9, wherein, the pressure fluid which is conducted to the hydraulically-actuated means of the first subsurface valve is the discharge pressure from the pump.

11. A submergible pump installation as set forth in claim 9, wherein, the pressure fluid which is conducted to the hydraulically-actuated means of the first subsurface valve is conducted from a source at the surface of the well.

12. A submergible pump installation as set forth in claim 9, wherein, the pressure fluid which is conducted to the hydraulically-actuated means of the first subsurface valve is the discharge pressure from the pump and also wherein, the means for conducting said pressure fluid is a conductor which is located exteriorly of the well tubing in which the pump is mounted.

13. A submergible pump installation for a well having a well casing and a well tubing therein, including a landing nipple comprising, a submergible pump having a lower intake and an upper discharge, said pump run in said tubing on means providing communication with the surface, means for mounting and sealing the pump within the well tubing, said sealing means being located between the intake end and the discharge end of said pump whereby when the pump is operating, well fluid is pumped into said intake and is discharged from said discharge end, a first subsurface valve having hydraulically-actuated means for controlling operation thereof, means for independently mounting and sealing said first valve within the well tubing at a point spaced below and physically disconnected from the submergible pump other than through the well tubing, means for conducting pressure fluid to the hydraulically-actuated means of said first subsurface valve to selectively open and close said valve, a second subsurface valve spaced below the first valve, and means forming part of the first valve and engageable with the second vlave when the first valve is moved to its open position to also open said second valve, said first and second valves controlling flow to the inlet of said pump and remaining in the well when the pump is pulled.

14. A submergible pump installation as set forth in claim 13, wherein the second subsurface valve has a straight-through bore which aligns with the well tubing bore when said second valve is in an open position.

15. A submergible pump installation as set forth in claim 13, wherein the second subsurface valve is a rotating ball-type valve having a straight-through bore which aligns with the well tubing bore when said second valve is in open position.

* * * * *